US012345136B1

(12) United States Patent
Barbour

(10) Patent No.: US 12,345,136 B1
(45) Date of Patent: Jul. 1, 2025

(54) GRAVEL PACK COMPACTION METHOD

(71) Applicant: Joel Barbour, Henderson, NV (US)

(72) Inventor: Joel Barbour, Henderson, NV (US)

( * ) Notice: Subject to any disclaimer, the term of this patent is extended or adjusted under 35 U.S.C. 154(b) by 0 days.

(21) Appl. No.: 18/815,544

(22) Filed: Aug. 26, 2024

(51) Int. Cl.
*E21B 43/04* (2006.01)

(52) U.S. Cl.
CPC ..... *E21B 43/045* (2013.01)

(58) Field of Classification Search
CPC ..... E21B 43/045
See application file for complete search history.

(56) References Cited

U.S. PATENT DOCUMENTS

2014/0060804 A1* 3/2014 Barbour ..... E21B 37/00 166/70
2016/0024888 A1* 1/2016 Parker ..... E21B 37/08 166/248

* cited by examiner

*Primary Examiner* — Dany E Akakpo
(74) *Attorney, Agent, or Firm* — SoCal IP Law Group LLP; John E. Gunther; Mark Andrew Goldstein

(57) ABSTRACT

A method for installing a gravel pack in a well. Gravel pack material is placed in the well. An arc discharge tool is lowered to a predetermined position within the well, the arc discharge tool for generating one or more electrical discharges between a pair of electrodes, each of the electrical discharges causing a shock wave within the well. The arc discharge tool generates at least one shock wave that propagates into the gravel pack material, and the arc discharge tool is withdrawn from the well.

14 Claims, 5 Drawing Sheets

© 2024 Joel Barbour

© 2024 Joel Barbour

© 2024 Joel Barbour

PRIOR
ART

© 2024 Joel Barbour

© 2024 Joel Barbour

GRAVEL PACK COMPACTION METHOD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to wells for oil gas, water or geothermal energy, and in particular, to methods for completing wells incorporating a gravel pack.

Related Art

Petroleum products such as oil and natural gas are commonly produced by drilling a borehole or wellbore into the earth into or through an oil or gas producing subsurface formation. Similarly, water or steam for geothermal energy may be extracted by drilling a wellbore into an appropriate subsurface formation. The fluid (i.e. oil, gas, water, steam, or a combination thereof) produced by a well will be referred to herein as the "product".

When the subsurface formation from which the fluid is extracted is soft or easily eroded, solid material from the formation may be extracted with the product. Particles of solid material, commonly referred to as "sand", may damage or degrade components of a well such as valves or pumps. "Gravel packing" is a known method of preventing or minimizing the amount of sand extracted from a well in which the product passes through a "gravel" bed before being extracted from the well. The gravel functions as a filter that passes the fluid product while blocking most or all of the solid sand. Gravel packing has been used for sand control in wells for more than forty years.

FIG. 1 shows simplified schematic diagrams of two exemplary wells incorporating gravel packs. The first exemplary well 100 is an example of an "openhole gravel pack". The first exemplary well 100 includes a casing 110 extending into a borehole 105 drilled into the earth. The casing 110 is typically composed of multiple, possibly hundreds, of pipe segments. Each pipe segment has a male thread on one end and a female thread on the other end such that adjacent drill pipe segments can be threaded together to form a continuous pipe. The outer diameter of the casing 110 may be from 2.5 inches to 16 inches or greater. The casing 110 is typically steel but may be polyvinyl chloride for shallow water wells.

The approximately annular space between the outside of the casing 110 and the inside of the borehole 105 is commonly filled with cement 115 to support the inside of the borehole 105 and to prevent fluids from traveling between different subterranean formations (e.g. to prevent oil from an oil-bearing formation from contaminating water in a water-bearing formation). In the well 100, the casing 110 and cement 115 do not extend to the bottom of the borehole 105, such that a lower portion 130 of the borehole is "uncased".

A production tube 120 passes through the casing 110. The approximately annular space between the outside of the production tube 120 and the inside of the casing 110 may be filled and sealed by one or more "packer" 125. A "packer" is a mechanical apparatus that is lowered into the well and then expanded to form a seal between the production tube and the casing.

A screen 135 extends from the bottom of the production tube into the uncased portion 130 of the borehole. The screen 135 may be, for example, a length of pipe with slots or other perforations to allow the product to flow into the interior of the screen and then up the production tube 120 to the surface.

The approximately annular space between the outside of the screen 135 and the uncased portion 130 of the borehole 105 is filled with a gravel pack 140. The gravel pack 140 may comprise fine gravel, coarse sand, or a synthetic material such as glass beads. The particles of the gravel pack 140 are too large to pass through the screen 135 yet small enough that the gravel pack is an effective filter to prevent sand from entering the production tube 120.

The second exemplary well 150 is an example of a "cased hole gravel pack." The well 150 includes a casing 160 extending into a borehole 155 drilled into the earth. The approximately annular space between the outside of the casing 160 and the inside of the borehole 155 is filled with cement 165 to support the inside of the borehole 105 and to prevent fluids from traveling between different subterranean. In the well 150, the casing 160 and cement 165 extend to the bottom of the borehole 155.

A portion of the casing 160 has perforations 170 to allow the product to enter the casing 160. In this example, the perforated portion is the lower end of the casing 160. The perforations in the casing 160 may be formed, for example, by a perforating tool that uses shaped explosive charges to form holes through the casing 160 and the surrounding cement 165. The perforating tool may also form "perforation tunnels" 175 in the subsurface layer.

A production tube 180 passes through the casing 160. The approximately annular space between the outside of the production tube 180 and the inside of the casing 160 may be filled and sealed by one or more packer 185.

A screen 190 extends from the bottom of the production tube. The approximately annular space between the outside of the screen 190 and the inside of the casing 160 is filled with a gravel pack 195. The gravel pack 195 may comprise fine gravel, coarse sand, or a synthetic material such as glass beads. The particles of the gravel pack 195 are too large to pass through the screen 190 yet small enough that the gravel pack is an effective filter to prevent sand from entering the production tube 180. Preferably, the gravel pack material fills the perforations in the casing 160 and the cement 165 and at least partially fills the perforation tunnels 175. Wells may be substantially more complex than the examples shown in FIG. 1.

A gravel pack is most effective when tightly compacted. Wells such as the examples 100 and 150 in FIG. 1, rely, to a large extent, on gravity to settle and compact the gravel pack. This can result in voids in the gravel pack and/or regions where the gravel is loosely packed. Such regions offer opportunities for sand to pass through the gravel pack and screen into the production tube.

This patent describes an improved method for installing a gravel pack that uses an arc discharge tool to generate shock wave directed into the gravel pack. An arc discharge tool generates a strong shock wave using an electric discharge between a pair of electrodes. The shock waves cause denser compaction of the gravel pack compared to gravity alone. Further, the strong shock wave generated by the arc discharge tool may drive the gravel pack material into and through casing perforations into perforation tunnels when present.

THE DRAWINGS

FIG. 1 contains simplified schematic diagrams of two exemplary wells.

Throughout this description, elements appearing in figures are assigned three-digit reference designators, where the most significant digit is the figure number where the element is first introduced, and the two least significant digits are specific to the element. An element that is not described in conjunction with a figure may be presumed to have the same characteristics and function as a previously-described element having the same reference designator.

DETAILED DESCRIPTION

Apparatus

Figure 2:
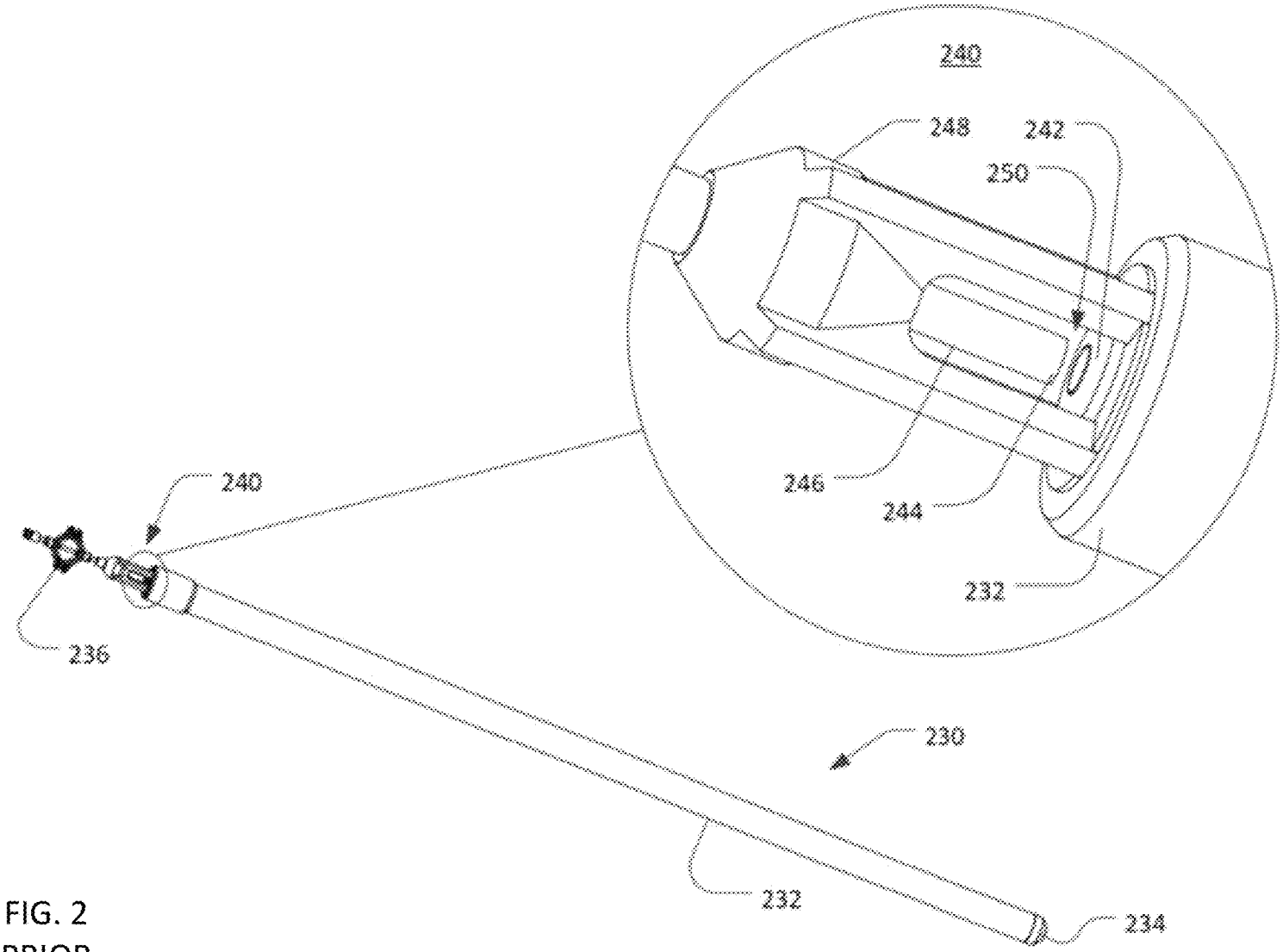
FIG. 2 is a perspective view of an exemplary arc discharge tool.

Referring now to FIG. 2, an exemplary arc discharge tool 230, as described in U.S. Pat. No. 8,950,495, may be suitable for use in the well remediation method described herein. Other configurations of arc discharge tools are possible and may be used in the method described herein.

The arc discharge tool 230 has an elongate cylindrical body 232 configured to be lowered into a well to the depth of a perforated portion of the well pipe. A first end 234 of the body is adapted to connect to a cable that provides electrical power to the arc discharge tool 230 and provides a mechanism to lower the arc discharge tool 230 into, and extract the arc discharge tool 230 from, the pipe. A discharge head 240 is located at the opposite end of the body 232. A conventional centralizer 236 may be attached adjacent the discharge head 240 to ensure that the discharge head is centrally located within the well pipe.

As shown in the detail view, the discharge head 240 has a first electrode 242 and a second electrode 246 separated by a gap 250. When a high voltage is placed between the first electrode 242 and the second electrode 246, an electrical discharge can occur across the gap 250. The high voltage may be applied such that either the first electrode 242 or the second electrode 246 is positive and the other electrode is negative. The electrical discharge will produce a substantial shock wave in the fluid present in the gap. The shock wave typically propagates symmetrically and outwardly from the gap to impact the interior wall of the pipe. When the discharge head 240 is positioned in the perforated portion of a well pipe, the shock wave may pass through the perforations in the pipe to impact the subsurface formation. The effect of the impact of the shock wave, in combination with the action of chemicals introduced into the well, may remove mineral deposits and organic materials from the inside of the pipe, the perforations, a gravel pack if present, and the surrounding subsurface formation.

The second electrode 246 is held by a holder 248 having three or four legs coupled to the body 232. The holder 248 holds the second electrode 246 in position to set a desired width of the gap 250 between the first and second electrodes. The holder 248 also provides an electrical connection between the body 232 and the second electrode 246.

The first electrode 242 is separated from the holder 248 by an insulator 244. Insulator 244 provides electrical isolation for the first electrode 242 and inhibits electrical discharge directly between the first electrode 242 and the legs of the holder 248.

Figure 3:
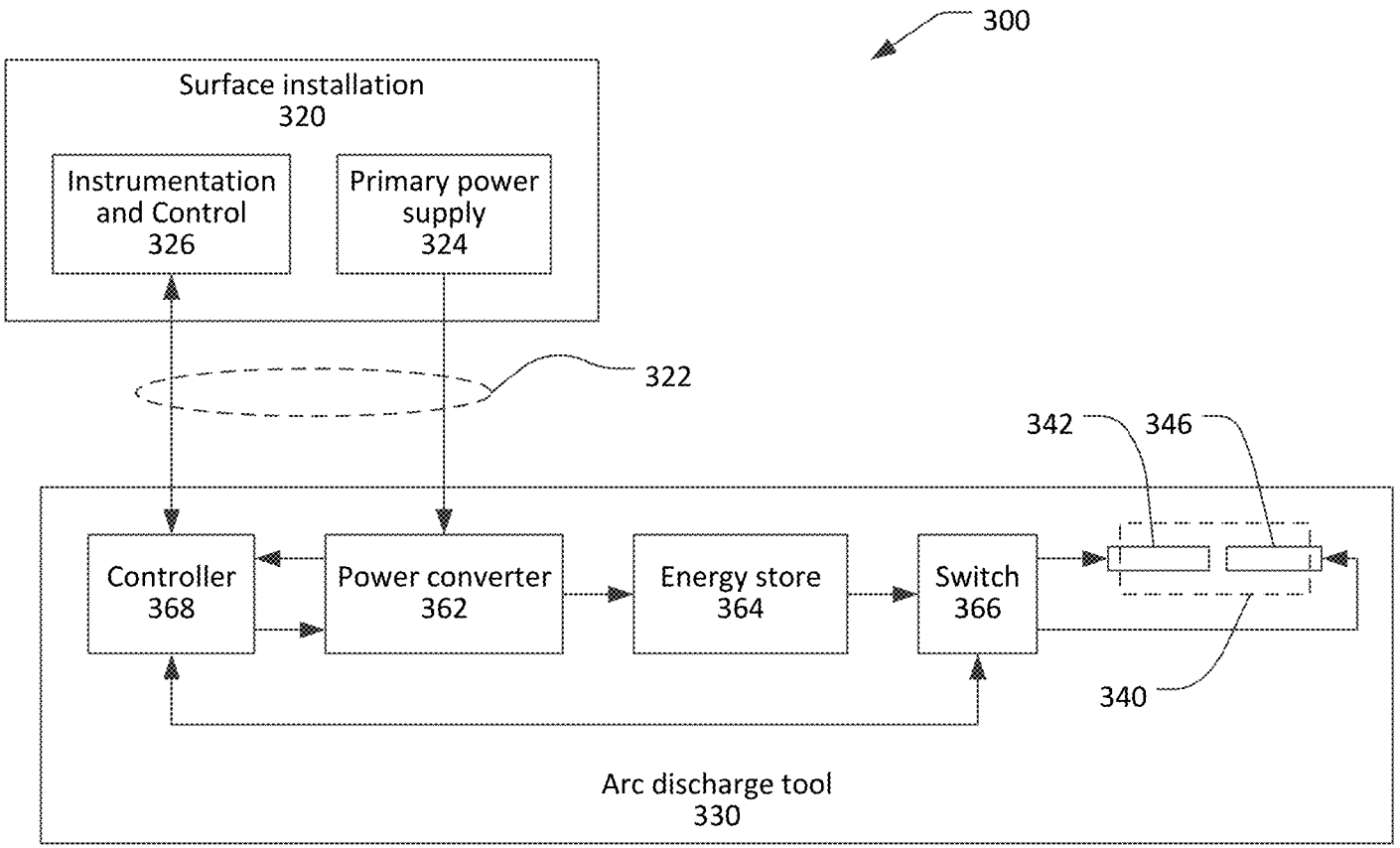
FIG. 3 PRIOR ART
FIG. 3 is a block diagram of the arc discharge tool.

FIG. 3 shows a block diagram of an arc discharge system 300 which includes an arc discharge tool 330, which may be the arc discharge tool 230 shown in FIG. 2. The arc discharge system 300 includes a surface installation 320 and the arc discharge tool 330 linked by a cable 322.

The cable 322 may include a wire rope or other structural member for raising and lowering the arc discharge tool 330 into the drill pipe. The cable 322 may also include at least a pair of electrical conductors for conveying electrical power from the surface installation 320 to the arc discharge tool 330. The cable 322 may include one or more additional electrical conductors or optical fibers for conveying data and control information between the surface installation 320 and the arc discharge tool 330.

Figure 1:
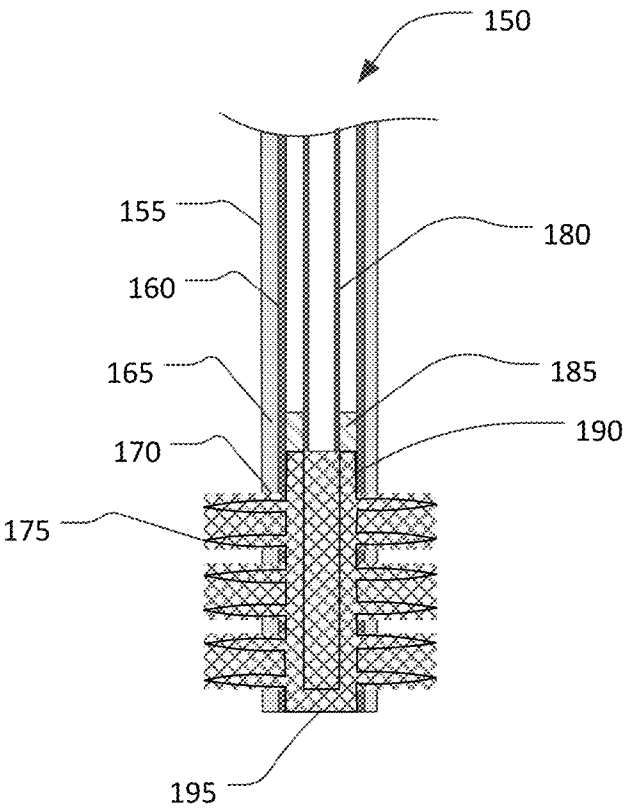
Figure 1:
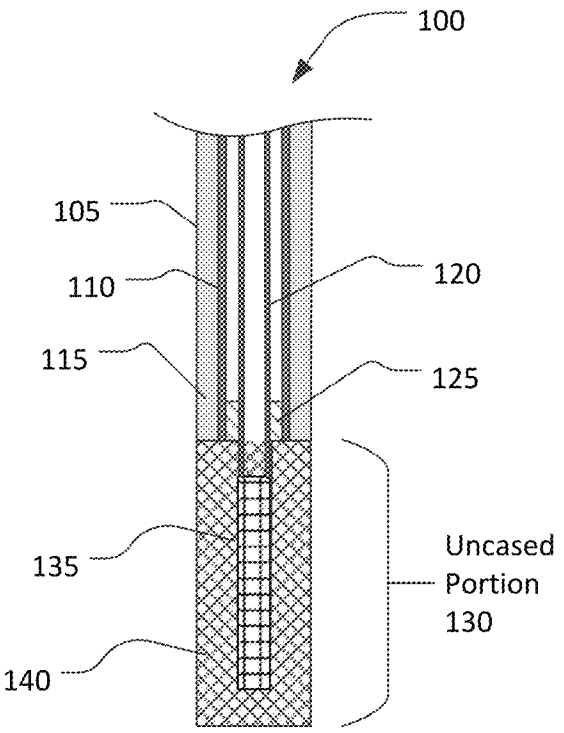

The surface installation 320 may commonly be housed in a truck, as illustrated in FIG. 1B, but is not limited to that implementation. The surface installation may include a primary power supply 324, which may be, for example, a generator or batteries. The primary power supply 324 may provide primary power to the arc discharge tool 330 via the cable 322. The primary power may be AC or DC power.

The surface installation 320 may also include an instrumentation and control subsystem 326 to control and document the operation of the cleaning tool. At a minimum, the instrumentation and control subsystem 326 may provide the ability to selectively enable operation of the arc discharge tool 330 when the tool is proximate the well screen and to selectively disable operation of the tool in other positions. This may be achieved via commands sent over cable 322. For example, the instrumentation and control subsystem 326 may be configured to control one or more of the rate at which the arc discharge tool 330 descends and ascends in the well pipe, the rate or frequency of electrical discharges produced by the tool 330, the electrical voltage or energy of each discharge, and other operational parameters. The instrumentation and control subsystem 326 may also document the operation of the arc discharge tool. For example, the instrumentation and control subsystem 326 may store or otherwise document the depth and time when the arc discharge tool 330 was activated, the time when the arc discharge tool 330 was deactivated, a count of the number of electric discharges that occurred between activation and deactivation, the time and depth of some or all of the electrical discharges, the time duration and/or peak current of some or all of the electrical discharges, and other information.

The arc discharge tool 330 may include a power converter 362, an energy storage 364, a switch 366, and a controller 368 housed with the body 332 of the arc discharge tool. The power converter 362 may receive primary power from a primary power supply via the cable 322 and may convert the primary power into DC power of sufficiently high voltage to create a discharge between electrodes 342 and 346.

The energy store 364 may be, for example, a high voltage capacitor or a plurality of capacitors connected in series and/or parallel to collectively function as a high voltage capacitor. The power converter 362 may be configured with a limited output current capacity, such that the energy store 364 may be gradually charged from a discharged state to the full voltage output from the power converter. Once the energy store 364 is charged to a desired voltage level, a switch 366 may connect the energy store to the electrodes 342 and 346, causing an electrical discharge that depletes the energy stored in the energy store 364. The power converter 362 may then begin recharging the energy store 364 in preparation for the next electrical discharge.

The switch 366 may be, for example, a triggered spark gap, a solid-state switch using a cascade of semiconductor devices, or a gas-filled or vacuum tube device such as a thyratron or krytron. The switch 366 may be another device or combination of devices capable of both blocking the high voltage level produced by the power converter and passing very high instantaneous current each time the stored energy is discharged through the electrodes 342, 346.

The controller 368 may be configured to control the operation of the cleaning tool and to periodically trigger the switch 366 to initiate a series of electrical discharges between the electrodes 342, 346. The discharge voltage level may be determined by the instrumentation and control subsystem 326 and communicated to the controller 368 in the well via the cable 322. The controller 368 may be configured to selectively enable and disable the operation of the arc discharge tool 330 in response to commands received from the instrumentation and control subsystem 326 via the cable 322. Alternatively, the operation of the arc discharge tool 330 may be enabled and disabled from the surface by selectively providing or not providing the primary power from the primary power supply 324. The controller 368 may also be configured to transmit feedback information to the instrumentation and control subsystem 326 via the cable 322.

Methods

Figure 4:
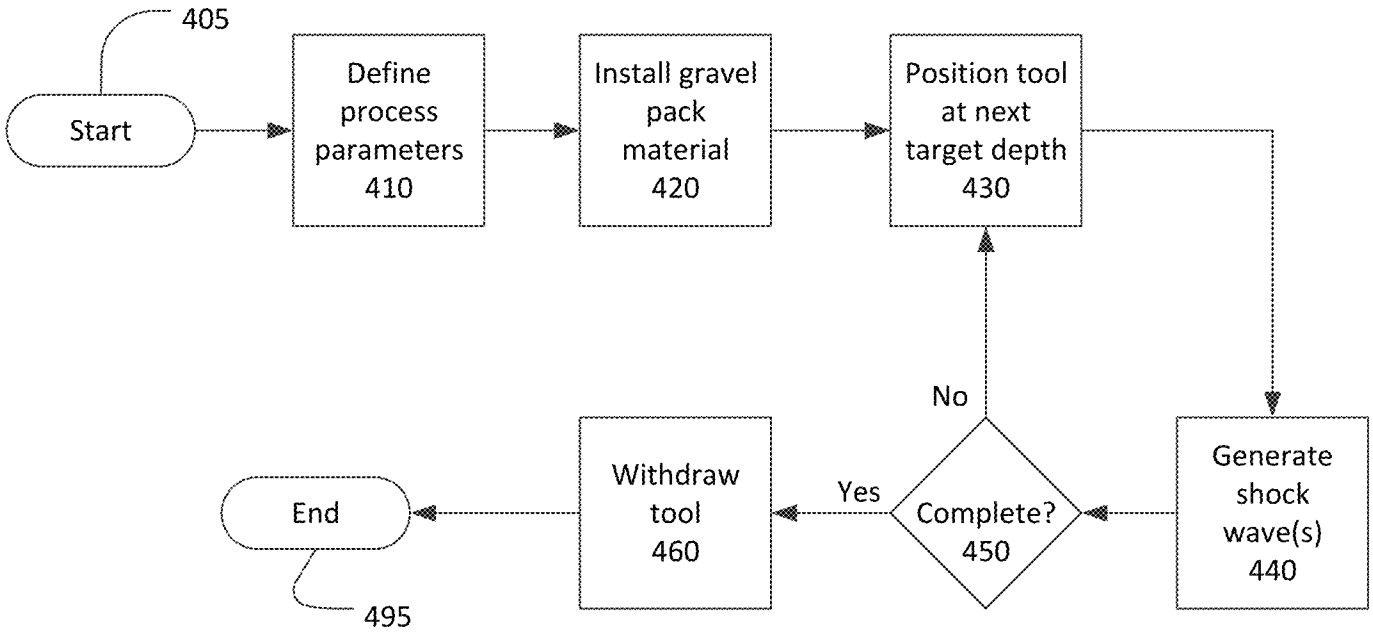
FIG. 4 is a flow chart of a process for installing a compacted gravel pack in a well.

Referring now to FIG. 4, a process 400 for installing a compacted gravel pack in a well may start at 405 and conclude at 495 after the process is completed.

At 410, parameters for installing the gravel pack may be determined. The parameters may include the type, size, and amount of gravel pack material to be introduced into the well. The selection of the type and size of the material may be based, at least in part, on samples of sand extracted from the well and/or the size of the slot or perforations in the well screen. The parameters may also include a depth range and a number of positions within the depth range where the arc discharge tool will be activated. The depth range may, for example, encompass the height of the well screen. The parameters may further include, for example, a spacing between the electrodes of the arc discharge tool, a peak voltage applied between the electrodes, an energy per discharge, and/or a discharge repetition rate. The spacing of the electrodes in the discharge head may be set based, at least in part, on the electrical conductivity or salinity of the fluids in the well. The spacing determined for the electrodes may be generally inverse to the conductivity of the fluids at the well screen. The electrodes may be closely spaced if the drill string in the well has low conductivity and the electrodes may be spaced further apart if the fluids are highly conductive. The energy per discharge may be set, at least in part, based on the inside diameter of the well screen. The operating parameters of the arc discharge tool may be set, in part, based on other parameters such as the temperature, viscosity, dielectric constant, or other parameter indicative of the fluid content at the well screen. Where necessary, a survey of the well may be performed by lowering one or more tools into the well to measure necessary parameters of the fluid at the screen.

At 420, the gravel pack material selected at 410 may be introduced into the well. A variety of known techniques and tools may be used to install the gravel pack.

At 430, the arc discharge tool may be lowered into the well to an initial position within the depth range defined at 410. For example, the arc discharge tool may be positioned proximate a low end of the well screen.

At 440, the arc discharge system may be activated to cause one or more discharges between electrodes of the arc discharge tool. The discharge energy, repetition rate, and number of discharges may be as defined at 410. Each discharge creates a shock wave within the well pipe. Each discharge/shock wave may jostle or vibrate the particles of the gravel pack. The movement of the particles, in combination with gravity, may cause the particles to pact more tightly, thus compacting the gravel pack.

At 450, a determination is made if the arc discharge tool has been activated at all of the positions defined at 410. For example, when the initial position of the arc discharge tool is proximate the bottom of the well screen, the arc discharge tool may be moved to one or more positions higher in the screen. When a determination is made at 450 that the arc discharge tool should be activated at one or more additional position ("no" at 450), the process returns to 430 and the arc discharge tool is moved to the next position.

When the arc discharge tool has been activated at all of the positions selected at 410 ("yes" at 450), the arc discharge tool is removed from the well at 460 and the process 400 ends at 495.

Figure 5:
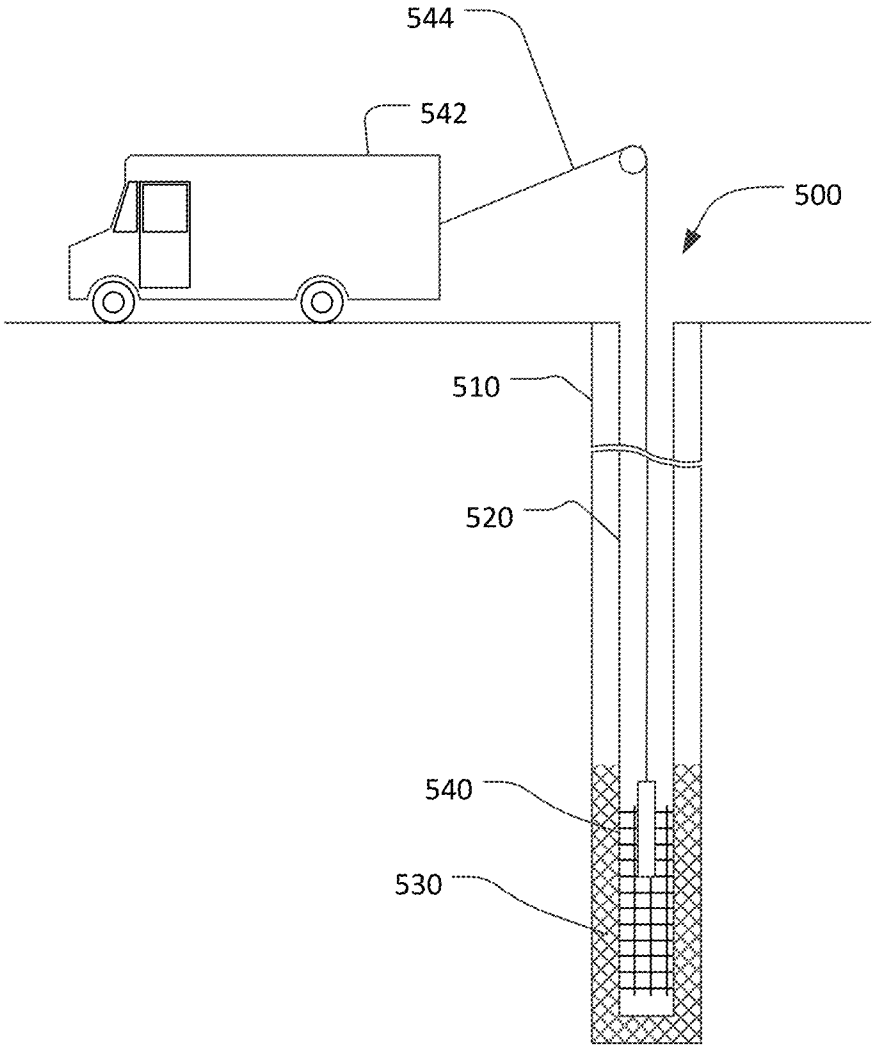
FIG. 5 is a simplified schematic diagram of a well during the process of FIG. 4.

FIG. 5 is a simplified cross-sectional view of a well 500 including a borehole 510, a pipe 520 and a screen 530 on the end of the pipe 520. An arc discharge tool 540 is positioned proximate a lower end of the screen 530. For example, as shown in FIG. 5, the arc discharge tool 540 may be lowered into the pipe 520 on a cable 544 supported by a derrick (not shown) or an arm (not shown) extending from a truck 542. The truck 542 contains the surface installation (320 in FIG. 3) of the arc discharge system and a winch to reel the cable in and out and thus control the depth of the arc discharge tool 540 within the well 500.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for installing a gravel pack in a well, comprising:

placing gravel pack material in the well;

lowering an arc discharge tool to a predetermined position within the well, the arc discharge tool configured to generate shock waves that cause compaction of the gravel pack material;

compacting the gravel pack material by generating, with the arc discharge tool, at least one shock wave that propagates into the gravel pack material; and withdrawing the arc discharge tool from the well.

2. The method of claim 1, further comprising:

prior to withdrawing the arc discharge tool from the well, repositioning the arc discharge tool at one or more additional positions within the well and, at each additional position, generating at least one shock wave that propagates into the gravel pack material.

3. The method of claim 1, further comprising:

prior to inserting the arc discharge tool, defining arc discharge tool operating parameters comprising one or more of a spacing between the pair of electrodes, a peak voltage applied between the pair of electrodes, an initial energy per discharge, and a discharge repetition rate.

4. The method of claim 3, wherein the arc discharge tool operating parameters are defined based, in part, on an inside diameter of the well at the predetermined depth.

5. The method of claim 3, wherein the arc discharge tool operating parameters are defined based, in part, on one or more of an electrical conductivity, a salinity, a temperature, a viscosity, and a dielectric constant of a fluids in the well at the predetermined depth.

6. A method for installing a gravel pack in a well including production tube with a screen, the method comprising:

filling an annular space outside of the screen with gravel pack material;

inserting an arc discharge tool into the production tube and lowering the arc discharge tool to a predetermined position within the screen, the arc discharge tool configured to generate shock waves that cause compaction of the gravel pack material;

compacting the gravel pack material by generating, with the arc discharge tool, at least one shock wave that propagates into the gravel pack material; and withdrawing the arc discharge tool from the well.

7. The method of claim 6, further comprising:

prior to withdrawing the arc discharge tool from the well, repositioning the arc discharge tool at one or more additional positions within the screen and, at each additional position, generating at least one shock wave that propagates into the gravel pack material.

8. The method of claim 6, wherein filling an annular space comprises filling an annular space between an outside of the screen and an inside of an uncased borehole.

9. The method of claim 6, wherein filling an annular space comprises filling an annular space between an outside of the screen and an inside of a perforated casing.

10. The method of claim 9, wherein at least some shock waves drive gravel pack material into perforations in the perforated casing.

11. The method of claim 9, wherein at least some shock waves drive gravel pack material through perforations in the perforated casing into perforation tunnels in the subsurface formation surrounding the casing.

12. The method of claim 6, further comprising:

prior to inserting the arc discharge tool, defining arc discharge tool operating parameters comprising one or more of a spacing between the pair of electrodes, a peak voltage applied between the pair of electrodes, an initial energy per discharge, and a discharge repetition rate.

13. The method of claim 12, wherein the arc discharge tool operating parameters are defined based, in part, on an inside diameter of the screen.

14. The method of claim 12, wherein the arc discharge tool operating parameters are defined based, in part, on one or more of an electrical conductivity, a salinity, a temperature, a viscosity, and a dielectric constant of a fluids in the screen.

* * * * *